US005263517A

United States Patent [19]

Ishikawa et al.

[11] Patent Number: 5,263,517

[45] Date of Patent: Nov. 23, 1993

[54] TONER PACK FOR USE WITH THE DEVELOPING DEVICE AND METHOD OF FILLING UP TONER FROM THE TONER PACK TO THE DEVELOPING DEVICE

[75] Inventors: Takashi Ishikawa, Tokyo; Jiro Fukasawa, Shirane; Shinji Tsuji, Yamanashi, all of Japan

[73] Assignees: Kabushiki Kaisha Toshiba, Kawasaki; Shindengen Electric Manufacturing Co., Ltd., Tokyo; Yamanashi Electronics Co., Ltd., Yamanashi, all of Japan

[21] Appl. No.: 868,524

[22] Filed: Apr. 15, 1992

[30] Foreign Application Priority Data

Apr. 16, 1991 [JP] Japan ..... 3-84222

[51] Int. Cl.[5] ..... B65D 43/00

[52] U.S. Cl. ..... 141/1; 141/319; 141/364; 141/375; 222/DIG. 1; 355/260

[58] Field of Search ..... 141/231-233, 141/363, 364, 366, 386, 1, 2, 365, 383, 375, 319-322; 220/359; 222/DIG. 1, 541; 355/260, 245; 206/527

[56] References Cited

U.S. PATENT DOCUMENTS

| | | | |
|---|---|---|---|
| 3,999,654 | 12/1976 | Pollack | 222/DIG. 1 |
| 4,062,385 | 12/1977 | Katusha et al. | 141/364 |
| 4,589,579 | 5/1986 | Morita | 222/DIG. 1 |
| 4,799,608 | 1/1989 | Oka | 222/DIG. 1 |
| 4,969,557 | 11/1990 | Oka | 141/366 |

FOREIGN PATENT DOCUMENTS

| | | | |
|---|---|---|---|
| 0178273 | 7/1988 | Japan | 355/260 |
| 0223483 | 9/1989 | Japan | 355/260 |

*Primary Examiner*—Ernest G. Cusick
*Attorney, Agent, or Firm*—Finnegan, Henderson, Farabow, Garrett & Dunner

[57] ABSTRACT

A toner pack for use with the developing device includes a toner box in which toner is stored and which is detachably set at the developing device, an endless seal sheet a portion of which is peelably bonded to the toner box to cover an opening of the toner box, a flat cylindrical cover member through which that portion of the endless seal sheet which does not cover the opening of the toner box is freely movably passed, and a pull portion which is freely movably passed through the cover member and one end of which is made continuous from the endless seal sheet.

9 Claims, 6 Drawing Sheets

TONER PACK FOR USE WITH THE DEVELOPING DEVICE AND METHOD OF FILLING UP TONER FROM THE TONER PACK TO THE DEVELOPING DEVICE

BACKGROUND OF THE INVENTION

1. Field of the Invention

The present invention relates to a toner pack for use with the developing device in the electrophotographic apparatus. It also relates to a method of filling up toner in the toner pack into the developing device.

2. Description of the Related Art

The electrophotographic apparatus is used in the copying machine, facsimile, laser printer and others. The electrophotographic apparatus houses a photosensitive drum, around which charging, exposing, developing, transferring and fixing devices are arranged in this order in the rotating direction of the drum.

The photosensitive drum is rotated by a drive means. The surface of the drum thus rotated is charged by the charging device. The surface of the drum is then exposed by the exposing device to form a latent image thereon. Further, toner is supplied from the developing device onto the surface of the drum to form a toner image thereon. The toner image on the surface of the drum is then transferred onto a sheet of the recording paper by the transferring device. Further, the toner image on the recording paper is fixed by the fixing device.

The developing device in the electrophotographic apparatus includes a body in which toner is stored, and toner in the device body is supplied onto the surface of the photosensitive drum. When toner in the device body is reduced to a low amount in the device body, it is newly filled up in the device body.

The toner pack exchanging system is used to fill up toner in the body of the developing device. A toner pack in which toner is stored is detachably set at the body of the developing device. When the device body becomes empty, the toner pack is detached from the device body and a new toner pack is set in it.

According to this system, toner is filled up from the toner pack directly into the device body. When toner is to be filled up, therefore, it can be prevented from scattering outside the device body to soil the device and its surroundings.

The conventional toner pack used by the toner pack exchanging system includes a toner box and a seal sheet. The toner box is shaped like a rectangle and provided with an opening at the bottom thereof and a toner inlet independent of the opening.

The seal sheet is peelably bonded to the rim of the opening of the toner box by heat to thereby seal the opening. The toner box is filled with toner through the toner inlet thereof. The toner inlet of the toner box is closed by a cap. The seal sheet has a length longer than two times the length of the opening of the toner box. That portion of the seal sheet which is not bonded to the opening is turned outside along the opening of the toner box.

The body of the developing device has an opening at the top thereof. The toner box is detachably attached to the opening of the device body. The free end of the seal sheet is projected outside from between the toner box and the device body when the toner box is set at the device body as described above. The free end of the seal sheet is pulled by the operator. The seal sheet is thus pulled outside the device body and gradually peeled off the opening of the toner box. The opening of the toner box is thus gradually opened. When the whole of the opening of the toner box is opened, toner in the toner box is dropped into the device body through the opening of the toner box and then through the opening of the device body. After toner is filled up in the device body, the toner box is used as a cover for the opening of the device body. When the amount of toner becomes small and it must be filled up in the device body, the toner box is detached from the device body and a new toner box is set at the opening of the device body.

However, the conventional toner pack has the following problems.

The inner face of that portion of the seal sheet which is bonded to the opening of the toner box is opposed to the inside of the toner box. Toner in the toner box, therefore, adheres to this inner face of the seal sheet. When that portion of the seal sheet which is bonded to the opening of the toner box is peeled off, therefore, it is pulled outside from between the toner box and the device body with its toner-adhering face directed downward.

Toner adhering to the inner face of the seal sheet is thus scattered to soil the inside of the electrophotographic apparatus.

Further, when the peeled-off seal sheet is handled by the operator, toner adhering to the seal sheet is also scattered to soil the surroundings of the apparatus and the clothes of the operator.

SUMMARY OF THE INVENTION

An object of the present invention is therefore to provide a toner pack for use with the developing device capable of preventing toner adhering to the seal sheet from scattering to soil the inside of the electrophotographic apparatus when the seal sheet is peeled off the toner box.

Another object of the present invention is to provide a toner pack for use with the developing device capable of preventing toner adhering to the seal sheet from scattering to soil the surroundings of the apparatus and the clothes of the operator when the peeled-off seal sheet is handled by the operator.

According to the present invention, there can be provided a toner pack for use with a developing device comprising a toner box for storing toner therein, said toner box being provided with an opening through which toner in it is discharged, and detachably set at a body of the developing device; a seal sheet formed endless, a part of which is peelably bonded to the toner box, covering the opening of the toner box, while the other part of which is left free outside the opening of the toner box; a flat cylindrical cover member having one open end and another open end at both ends thereof, said cover member having a length larger than that of the opening of the toner box, being positioned outside that portion of the endless seal sheet which covers the opening of the toner box, and having that portion of the endless seal sheet, which is left free not to cover the opening of the toner box, freely movably passed through the cover member; and a pull portion freely movably passed through the cover member, an end of said pull portion projecting from the one open end of the cover member and connected to the endless seal sheet, while the other end thereof projecting free outside the other open end of the cover member.

According to the present invention, there can be provided a method of filling up toner from the toner pack into the body of the developing device comprising pulling the pull portion to peel off the endless seal sheet from the toner box to open the opening of the toner box while keeping the toner box set at the device body; moving the peeled-off portion of said endless seal sheet into the flat cylindrical cover member; pulling said endless seal sheet and said cover member outside the developing device from between the toner box and the device body; and dropping toner in the toner box into the device body through the opening of the toner box.

In order to open the opening of the toner box, the pull portion is pulled along the flat cylindrical cover member to peel off that portion of the endless seal sheet, which is bonded to the opening of the toner box, from the opening of the toner box. As the pull portion is pulled, the endless seal sheet is moved around the cover member, causing that portion of the endless seal sheet, which is peeled off the toner box, to be moved into the cover member and also causing that portion of the endless seal sheet, which is held in the cover member, to be moved outside the cover member.

When the endless seal sheet is moved around the cover member in this manner, one end of the cover member is pushed forward by that portion of the endless seal sheet which is moved into the cover member. On the other hand, the other end of the cover member is held to limit its forward advancing by that portion of the endless seal sheet which is moved outside the cover member.

When the endless seal sheet is peeled off the toner box, therefore, the cover member can be moved at the same speed as the peeled-off speed of the endless seal sheet. This can prevent the cover member from popping out of the device body. In addition, the whole of that portion of the endless seal sheet which is peeled off the toner box can be housed and hidden in the cover member. This can prevent toner adhering to this portion of the endless seal member from scattering outside.

When the endless seal sheet is peeled off the toner box, therefore, toner adhering to the seal sheet can be prevented from scattering to soil the inside of the electrophotographic apparatus. Further, when the peeled-off seal sheet is handled by the operator, toner adhering to the seal sheet can be prevented from scattering to soil the surroundings of the apparatus and the clothes of the operator.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
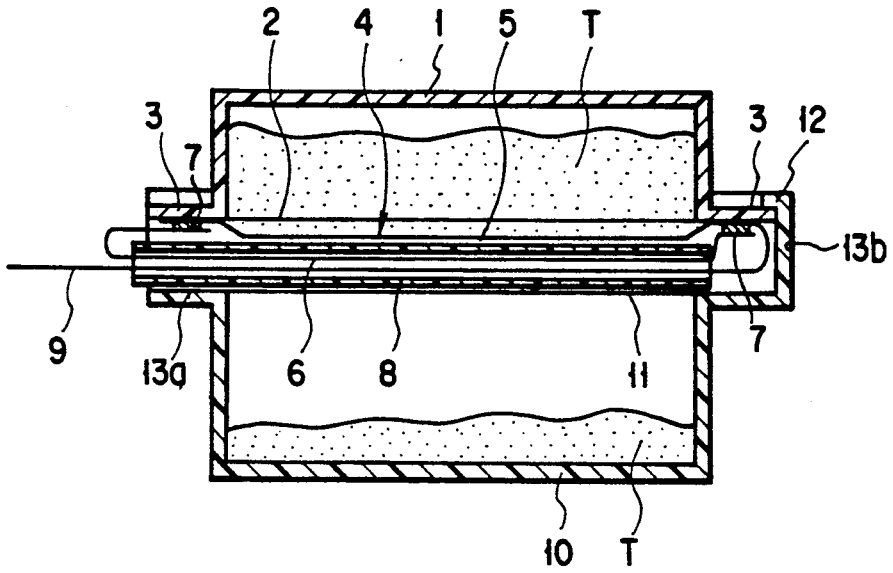
FIG. 1 is a sectional view showing the toner pack according to a first embodiment of the present invention set in the body of the developing device.

Some embodiments of the present invention will be described with reference to the accompanying drawings.

FIGS. 1 through 5 show a first embodiment of the present invention. Reference numeral 1 denotes a toner box shaped like a rectangle that is longer in the horizontal direction. The toner box 1 has an opening 2 extending along the longitudinal direction of the box 1 at the bottom thereof. A collar 3 is formed along the opening 2 of the box 1, projecting outside from four sides thereof. Toner T; which will be supplied into the developing device, is contained in the toner box 1.

Figure 2:
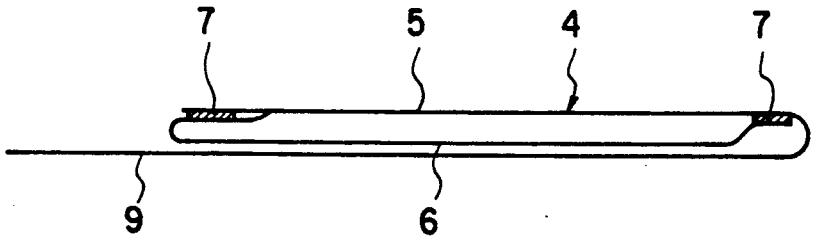
FIG. 2 shows an endless seal sheet and a pull portions.
Figure 3:
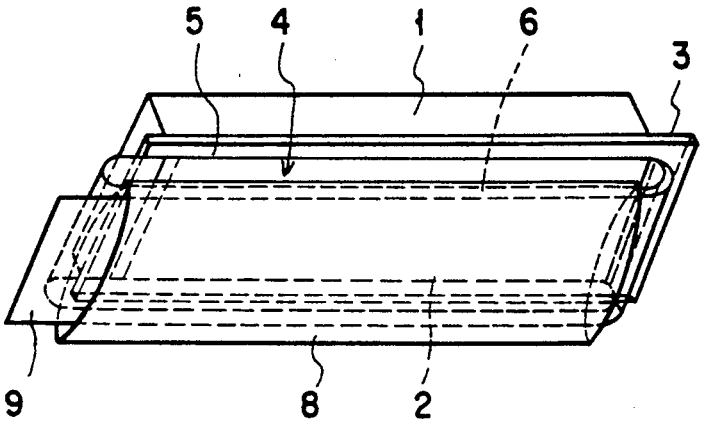
FIG. 3 is a perspective view showing the toner pack.

Reference numeral 4 represents an endless seal sheet comprising a combination of an adhesive sheet portion 5 and a normal sheet portion 6, as shown in FIG. 2. The adhesive sheet portion 5 is like a strap. It has a total length which is the sum of a length equal to that of the opening 2 of the toner box 1 and of a length including its adhesive margin relative to the collar 3 of the box 1. It also has a total width which is the sum of a width equal to that of the opening 2 and of a width including its adhesive margin relative to the collar 3. It is made of synthetic resin. The normal sheet portion 6 is also like a strap having a total length which is the sum of a length equal to that of the opening 2 and of a length equal to the adhesive margin of adhesive sheet portion 5 relative to the collar 3. Its width, however, is narrower than that of the adhesive sheet portion 5. It is also made of synthetic resin.

The adhesive sheet portion 5 is placed on the normal sheet portion 6 and both ends of the normal sheet portion 6 are bonded to one side or underside of the adhesive sheet portion 6 by adhesive 7 in this case. The adhesive sheet portion 5 and the normal sheet portion 6 are thus combined to form the endless seal sheet 4.

The adhesive sheet portion 5 is peelably bonded to the collar 3 of the toner box 1 at its adhesive margin by heat, for example, covering the whole of the opening 2 of the box 1. The opening 2 of the toner box 1 is sealed by the adhesive sheet portion 5 which is a part of the endless seal sheet 4 so as not to allow toner T to be leaked outside the toner box 1 through the opening 2. The normal sheet portion 6 is opposed to the opening 2 of the toner box 1 with the adhesive sheet portion 5 interposed between them.

Reference numeral 8 denotes a cover member shaped like an envelope and open at both ends thereof. It is made of synthetic resin having a rigidity higher than that of each of the sheet portions 5 and 6. It has a total length which is the sum of a length equal to that of the opening 2 of the toner box 1 and of a length equal to that of the adhesive margin of the adhesive sheet portion 5. Its width is larger than that of each of the sheet portions 5 and 6 of the endless seal sheet 4. Its total length, however, is smaller than that of each of the sheet portions 5 and 6.

The cover member 8 is arranged under and along the longitudinal direction of the toner box 1 and the normal sheet portion 6 of the endless seal sheet 4, which is not bonded to the toner box 1 is passed through the cover member 8 and is movable. Both ends Of the endless seal sheet 4 or both bonded ends of the adhesive and normal sheet portions 5 and 6 are located outside and adjacent to both ends of the cover member 8. The endless seal sheet 4 becomes flat with its normal sheet portion 6 passed through the cover member 8.

Reference numeral 9 represents a pull portion having a width equal to that of the normal sheet portion 6 of the endless seal sheet 4. It also has a total length which is the sum of a length equal to that of the toner box 1 and of a length allowing the user to hold it by fingers. In short, it is longer than the cover member 8. It is made of synthetic resin. Its one end is connected to that part of the endless seal sheet 4 which is projected from one end of the cover member 8. In short, it is made integral to the adhesive sheet portion 5 of the endless seal sheet 4, extending from one end of the adhesive sheet portion 5.

More specifically, the pull portion 9 is passed, freely movable in the longitudinal direction, through the cover member 8, extending from the adhesive sheet portion 5 of the endless seal sheet 4 and outside the one open end of the cover member 8. The free end of the pull portion 9 thus passed through the cover member 8 is projected from the other open end of the cover member 8 and then outside the collar 3 of the toner box 1. This free end of the pull portion 9 is attached to the collar 3 of the toner box 1 by an adhesive tape (not shown). The pull portion 9 and the cover member 8 are thus supported by the toner box 1.

Since the endless seal sheet 4 and the pull portion 9 are separate components as has been described, the sheet 4 can be made more easily than otherwise. It would be difficult to form the sheet 4 integral with the pull portion 9, or to connect the pull portion 9 to the sheet 4 by means of an automatic machine.

Figure 4:
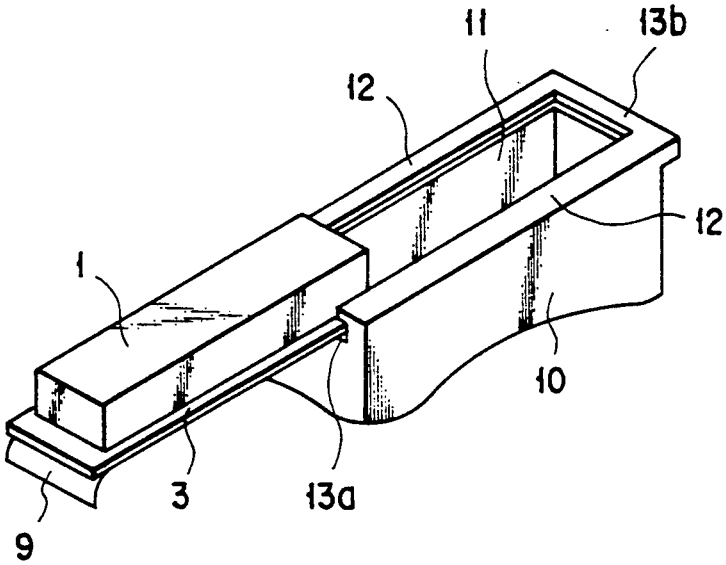
FIG. 4 is a perspective view showing how the toner pack is set in the device body

Referring to FIGS. 1, 4 and 5, it will be described how toner in the toner pack is filled up in the developing device.

The developing device body is a tank of rectangular parallelepiped 10 in which toner T is stored. The device body 10 has at its top a rectangular opening 11 same in size as the one 2 of the toner box 1 and it has rails 12, 12 along both sides of the opening 11. The rails 12, 12 are grooves formed on both sides of the opening 11, and the opening 11 is cut away at one end thereof to form a cut-away portion 13*a*, as shown in FIG. 4, which allows the toner box 1 to be inserted into and removed from the opening 11 of the device body 10 while being guided by the rails 12. The opening 11 is closed at the other end thereof, also as shown in FIG. 4, to form a stopper 13*b*, which serves to stop the toner box 1 inserted.

As shown in FIG. 4, the toner box 1 is set at the opening 11 of the device body 10 with its opening 2 directed downward. Those portions of the collar 3 which are projected from both sides of the toner box 1 are fitted into the rails 12 of the opening 11 of the device body 10 through the cut-away portion 13*a* of the opening 11. The toner box 1 is then moved to the stopper 13*b* of the opening 11. When the opening 2 of the toner box 1 coincides with that of the device body 10, the toner box 1 is stopped. The toner box 1 is thus set at the opening 11 of the device body 10 by a combination of the collar 3 and the rails 12.

FIG. 1 shows the toner box 1 set in the device body 10. Toner T in the toner box 1 is held by the adhesive sheet portion 5 of the endless seal sheet 4, which is bonded to the opening 2 of the toner box 1, not to drop from the toner box 1 through the opening 2 thereof. The normal sheet portion 6, the pull portion 9 and the cover member 8 are held between the collar 3 of the toner box 1 and the rails 12, 12 of the opening 11 of the device body 10. The free end of the pull portion 9 projected from the cover member 8 extends outside the device body 10 between the collar 3 of the toner box 1 and the cut-away portion 13*a* of the opening 11.

Referring to FIG. 5, it will be described how the seal sheet 4 of the toner pack is peeled off to fill up toner T into the device body 10.

Figures 5A, 5B, 5C:
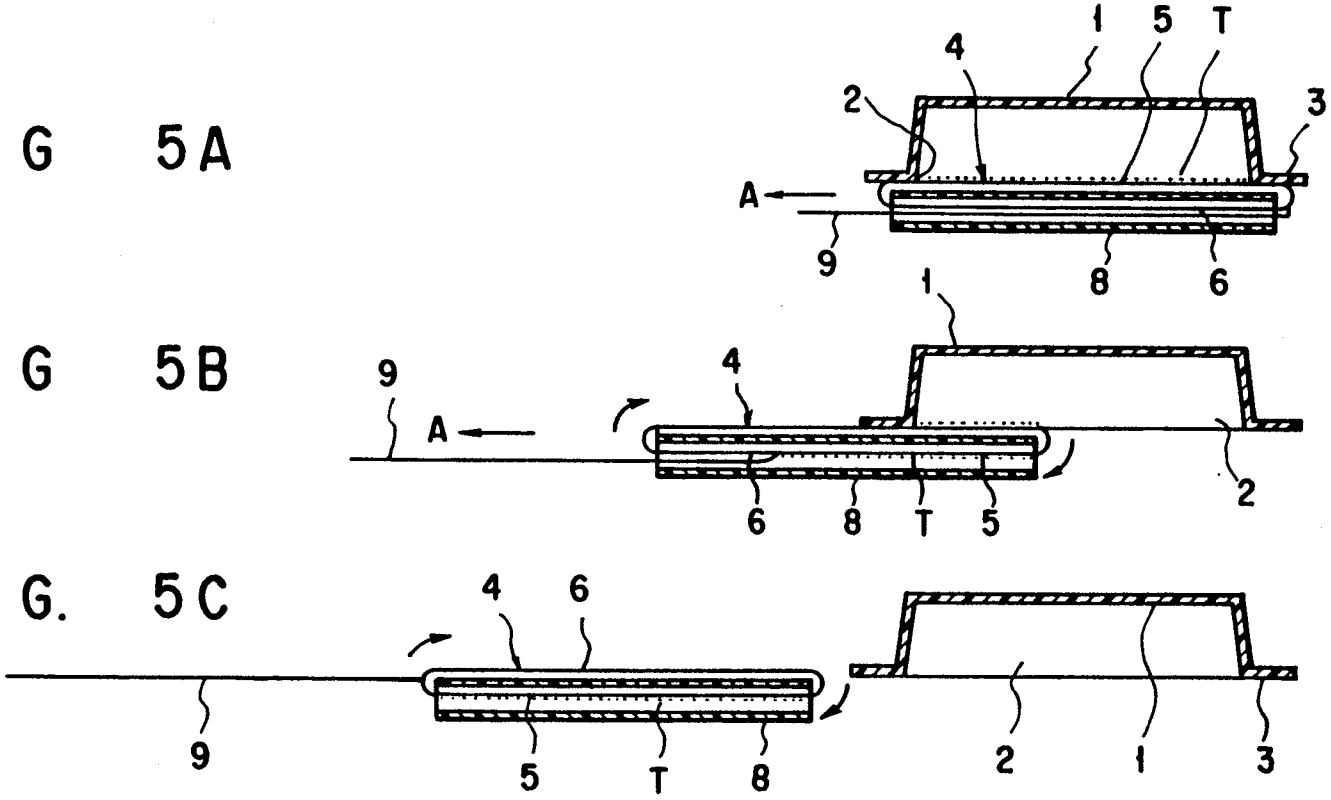
FIGS. 5A to 5C show how the seal sheet is peeled off.

FIG. 5A shows the toner pack set at the opening 11 of the device body 10. The user or operator peels off the adhesive tape by which the free end of the pull portion 9 is attached to the collar 3 of the toner box 1. He then pulls the free end of the pull portion 9 by fingers.

As shown in FIG. 5B, the normal sheet portion 6 of the endless seal sheet 4 following the pull portion 9 is gradually moved in a peeling direction (or pulling direction of the pull portion 9) A, passing through the cover member 8, then outside it and then onto it.

Therefore, the adhesive sheet portion 5 bonded to the collar 3 of the toner box 1 is gradually peeled off the collar 3 and moved into the cover member 8 in the pulling direction A.

Toner T in the toner box 1 adheres to the inner face of the adhesive sheet portion 5 which is bonded to the toner box 1. This toner-adhering adhesive sheet portion 5 is therefore gradually peeled off the collar 3 and housed in the cover member 8.

As the pull portion 9 is pulled, the endless seal sheet 4 is gradually moved around the cover member 8 in the pulling direction A and the adhesive sheet portion 5 is thus gradually peeled off the opening 2 of the toner box 1. As the endless seal sheet 4 is peeled off the toner box 1 in this manner, the opening 2 of the toner box 1 is gradually opened in the longitudinal direction thereof. Toner T in the toner box 1 is therefore dropped into the device body 10, passing through the opened opening 2 of the toner box 1 and then through the opening 11 of the device body 10.

When the endless seal sheet 4 is moved around the cover member 8, that open end of the cover, member 8 which is positioned in the rear relative to the pulling direction A, is pushed by the endless seal sheet 4 and the cover member 8 is thus moved forward in the pulling direction A. Therefore, the endless seal sheet 4 and the cover member 8 are pulled outside the device body 10 through the cut-away portion 13*a* of the opening 11.

When the endless seal sheet 4 is moved around the cover member 8, that open end of the cover member 8 which is positioned in the front relative to the pulling direction A is struck against the endless seal sheet 4. The endless seal sheet 4 is thus moved in the pulling direction A while holding the cover member 8. The cover member 8 is therefore moved outside the toner box 1 while its movement in the pulling direction A is controlled by the endless seal sheet 4. When the endless seal sheet 4 is peeled off the opening 2 of the toner box 1 by the pull portion 9, therefore, the cover member 8 is pulled in the pulling direction A by the pull portion 9, not to come out of the opening 11 of the device body 10 faster than the endless seal sheet, but to come out of it together with the endless seal sheet 4.

When the endless seal sheet 4 and the cover member 8 are moved in the pulling direction A by a distance equal to the length of the toner box 1, as shown in FIG. 5C, the endless seal sheet 4 is completely peeled off the toner box 1. The whole of the adhesive sheet portion 5 is thus peeled off the toner box 1 and housed or hidden in the cover member 8. The normal portion 6 of the endless seal sheet 4 and the cover member 8 are pulled outside the device body 10 through the cut-away portion 13*a* of the opening 11.

When the cover member 8 is pulled outside the toner box 1 in this manner, the whole of the adhesive sheet portion 5 of the endless seal sheet 4 to which toner T adheres is housed and hidden in the cover member 8. This prevents toner T, which adheres to the adhesive sheet portion 5, from scattering and falling from the seal sheet 4.

When the seal sheet 4 is peeled off the toner box 1, therefore, toner T which adheres to the seal sheet 4 can be prevented from scattering and falling in the copying machine to soil the inside of the machine. In other words, unless the adhesive portion 5 of the endless seal sheet 4 is contained in its entirety within the cover member 8 after the member 8 has been pulled out of the toner box 1, the toner T on the portion 5 is likely to fall into the copying machine and make the inner components thereof dirty.

Further, when the seal sheet 4 is peeled off and is to be handled outside the machine, toner T adhering to the sheet 4 can be prevented from scattering and falling outside the machine to soil the surroundings and clothes of the operator by the machine.

In the case of this embodiment, the pull portion 9 is integral with the adhesive sheet portion 5. When the pull portion 9 is pulled in the pulling direction A, therefore, the adhesive sheet portion 5 can be pulled together with the pull portion 9 without breaking from the pull portion 9. This enables the adhesive sheet portion 5 to be reliably peeled off the collar 3 of the toner box 1 to open the opening 11 of the device body 10.

Further, each of the adhesive and normal sheet portions 5 and 6 of the endless seal sheet 4 is shaped like a strap having a width substantially equal to that of the cover member 8. This enables the endless seal sheet 4 to be stably moved and its peeling-off movement to be smoothly achieved.

Figure 7:
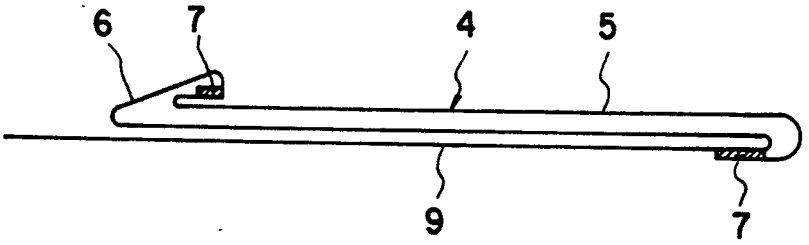
FIG. 7 shows another endless seal sheet and another pull portion.
Figures 8A, 8B, 8C, 8D, 8E:
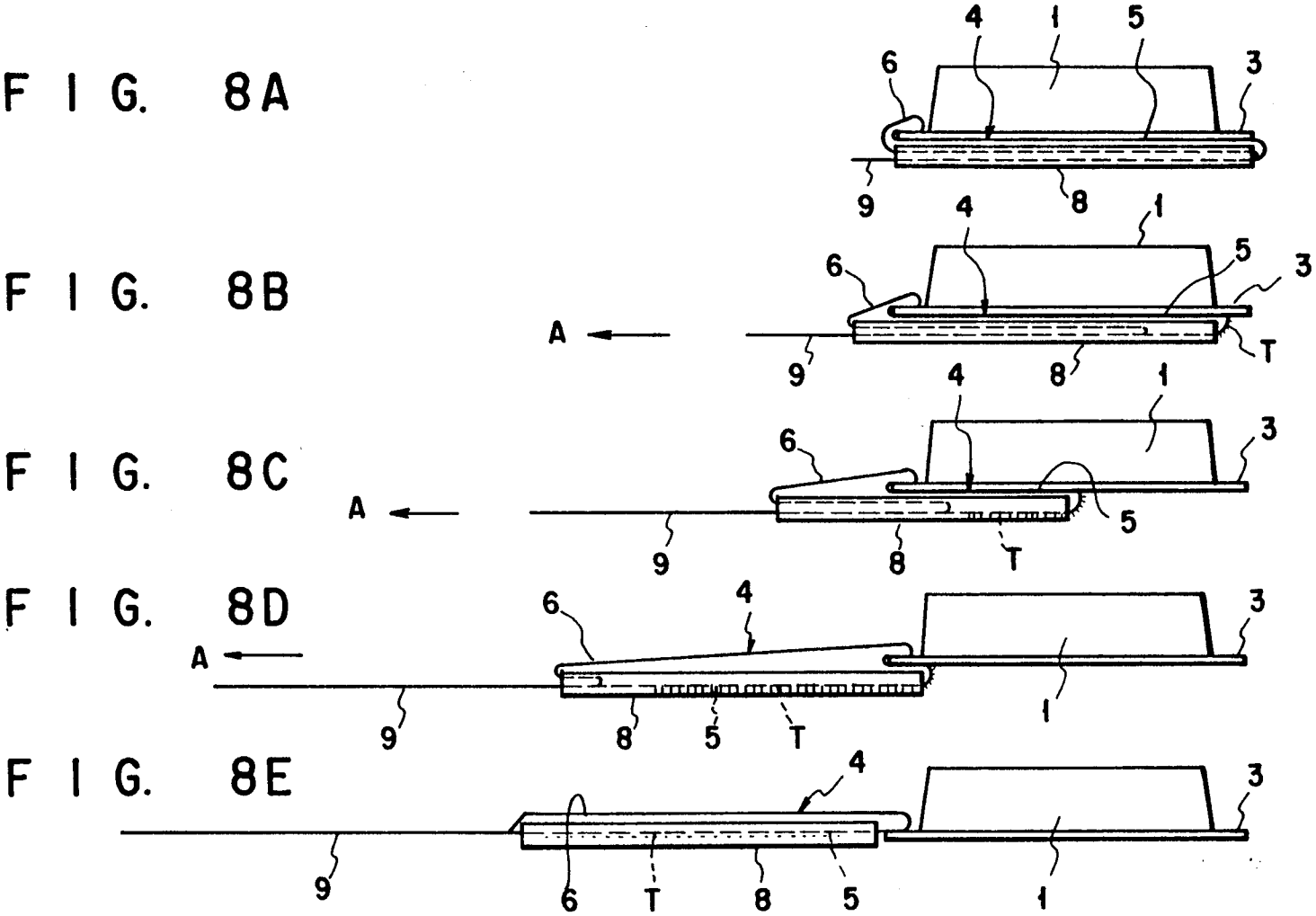
FIGS. 8A to 8E show how the seal sheet is peeled off.

A second embodiment of the present invention will be described with reference to FIGS. 6 through 8. Components that are the same as those in the first embodiment will be represented by same reference numerals The endless seal sheet 4 includes the adhesive and normal sheet portions 5 and 6 which are independent of each other and both ends of the normal sheet portion 6 are bonded to the adhesive sheet portion 5 by adhesive 7, as shown in FIG. 7. The pull portion 9 is integral with the normal sheet portion 6.

Figure 6:
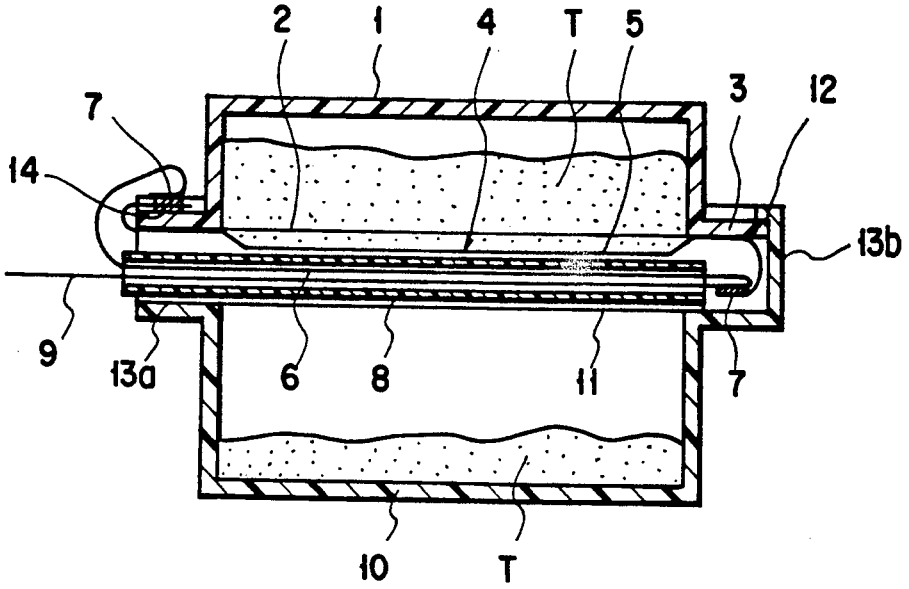
FIG. 6 is a sectional view showing the toner pack according to a second embodiment of the present invention set in the device body.

The endless seal sheet 4 is set at the opening 2 of the toner box 1, as shown in FIG. 6, fundamentally in the same manner as in the first embodiment. Those ends of the sheet portions 5 and 6 which are located in the front in relation to the pulling direction A, however, are bent upward and bonded to the top of the collar 3 of the toner box 1 by adhesive 14.

FIGS. 8A to 8E show how the endless seal sheet 4 is peeled off the toner box 1. The peeling-off movement of the sheet 4 is the same as in the first embodiment and its description will be omitted accordingly. When the whole of the cover member 8 is pulled outside the toner box 1, however, the cover member 8 and the endless seal sheet 4 do not full downward because a part of the sheet 4 is bonded to the collar 3 of the toner box 1. This prevents the endless seal sheet 4 from falling to scatter toner T adhering to it.

Further, each of the adhesive and normal sheet portions 5 and 6 of the endless seal sheet 4 is shaped like a strap having a width substantially equal to that of the cover member 8. This enables the endless seal sheet 4 to be stably moved and its peeling-off movement to be smoothly achieved.

Figure 9:
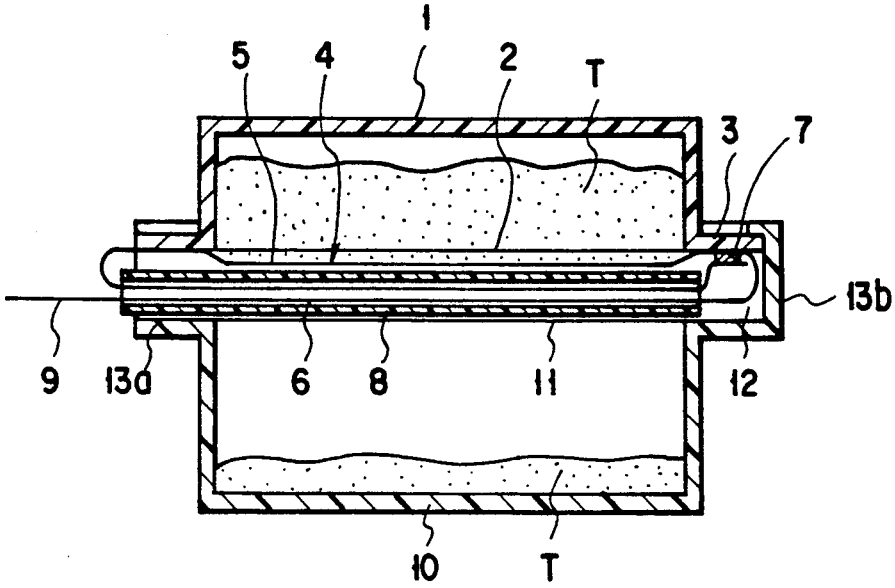
FIG. 9 is a sectional view showing the toner pack according to a third embodiment of the present invention set in the device body.

A third embodiment of the present invention will be described referring to FIG. 9.

According to this third embodiment, that end of the adhesive sheet portion 5 which is located forward with respect to the pulling direction A is made integral to and continuous from the end of the normal sheet portion 6 which is also located front in the pulling direction A. In addition, that end of the sheet portion 6 which is located rearward with respect to the pulling direction A is bonded to the adhesive sheet portion 5 by adhesive 7. The pull portion 9 is made integral to that end of the adhesive sheet portion 5 which is located rearward with respect to the pulling direction A. When the pull portion 9 is pulled in the pulling direction A, therefore, the adhesive sheet portion 5 can be pulled together with the pull portion 9 without breaking from the same. This enables the adhesive sheet portion 5 to be reliably peeled off the collar 3 of the toner box 1 to open the opening 11 of the device body 10. In addition, each of the adhesive and normal sheet portions 5 and 6 of the endless seal sheet 4 is shaped like a strap having a width substantially equal to that of the cover member 8. The endless seal sheet 4 can be therefore stably moved and its peeling-off movement can be smoothly achieved.

The endless seal sheet 4, the cover member 8 and the pull portion 9 are not limited to the above-described ones.

Figure 10:
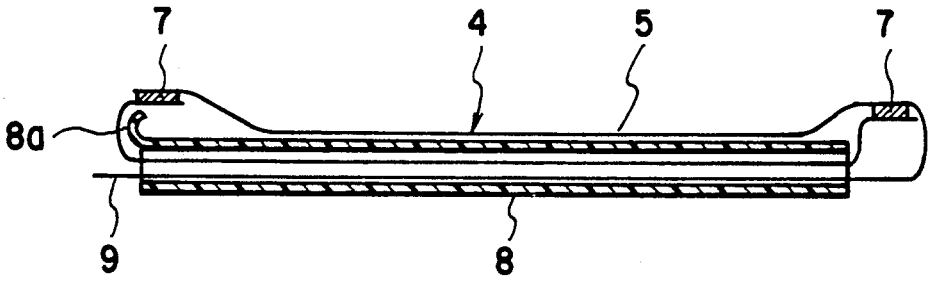
FIG. 10 shows a variation of the flat cylindrical cover member.

As shown in FIG. 10, for example, the upper end of the cover member 8 which is located forward with respect to the pulling direction A may be curved upwardly to form an upwardly curved piece 8*a*. When the endless seal sheet 4 is moved round the cover member 8 in this case, the sheet portion 6 can be more smoothly moved along the upward-curved piece 8*a* without being caught by the front end of the cover member 8.

The normal sheet portion 6 of the endless seal sheet 4 may be shaped like a string.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A method of filling toner from a toner pack having a toner box into a toner receptacle in a developing device, the method comprising:

slidably mounting the toner pack onto the developing device over the toner receptacle;

providing a pull member having a first end connected to a closed loop seal sheet, said seal sheet having a first part which covers an opening in said toner box and a second part that extends through a flat cylindrical cover member having first and second open opposite ends, said pull member being connected to said seal sheet adjacent the first open end of said cover member and extending through said cover member to the second open end thereof;

pulling the pull member such that said closed loop seal sheet is peeled off of the toner box to uncover the opening of the toner box while keeping the toner pack mounted on the developing device;

moving the second part of said seal sheet into the flat cylindrical cover member while pulling said pull member;

pulling said closed loop seal sheet through the cover member from between the toner box and the toner receptacle of the developing device; and dropping toner from the toner box into the toner receptacle through the opening of the toner box.

2. A toner pack for use with a developing device comprising:

a toner box for storing toner therein and having an opening through which toner is discharged, the toner box being detachably mountable to the developing device;

an endless seal sheet having first and second parts, the first part being peelably bonded to the toner box and covering the opening of the toner box, the second part being disposed outside the opening of the toner box;

a flat cylindrical cover member having first and second open ends, said cover member having a length larger than that of the opening of the toner box and being positioned outside of the first part of the endless seal sheet such that the second part of the endless seal sheet is freely movably passed through the cover member; and a pull member freely movably passed through the cover member and having a connector end and a pulling end, the connector end of said pull member being projected through one of the first and second open ends of the cover member and being connected to the endless seal sheet, the pulling end being projected through one of the first and second open ends of the cover member and being free outside of the cover member.

3. The toner pack for use with a developing device according to claim 2, wherein said first and second parts of said endless seal sheet are independent of each other and bonded to each other at a common end, and an end of the first part of the endless seal sheet is the pull member.

4. The toner pack for use with a developing device according to claim 2, wherein said first and second parts of said endless seal sheet are independent of each other and bonded to each other at a common end, and an end of the second part of the endless seal sheet is the pull member.

5. The toner pack for use with a developing device according to claim 2, wherein the first part of said endless seal sheet is integral to and continuous from the second part of said endless seal sheet, the first and second parts of said endless seal sheet being bonded to each other at a common end, and wherein the pull member is integral to and continuous from the first part of said endless seal sheet.

6. The toner pack for use with a developing device according to claim 2, wherein an upwardly curving guide piece extends from an upper portion of one of the first and second open ends of said cover member to guide the endless seal sheet.

7. A toner pack comprising:

a toner box having an opening through which toner is discharged;

a closed loop seal sheet having first and second parts, the first part being peelably bonded to the toner box to cover the opening of the toner box, the second part being located outside of the opening;

a cylindrical cover member having first and second open ends, the cover member being positioned outside of the first part; and a pull member freely movably positioned in the cover member and having a connector end and a pulling end, the connector end of said pull member passing through one of the first and second open ends of the cover member and being connected to the seal sheet, and the pulling end also passing through one of the first and second open ends of the cover member.

8. The toner pack of claim 7, wherein the second part of the seal sheet is freely movably passed through the cover member.

9. The toner pack of claim 7, wherein the first part is coterminous with the second part of the seal sheet, the first and second parts being bonded to each other at a common end, and the pull member is coterminous with the first part.

* * * * *